US008714908B2

(12) United States Patent
Dutka et al.

(10) Patent No.: US 8,714,908 B2
(45) Date of Patent: May 6, 2014

(54) SHROUD LEAKAGE COVER

(75) Inventors: Michael James Dutka, Simpsonville, SC (US); Venkata Siva Prasad Chaluvadi, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 825 days.

(21) Appl. No.: 12/940,341

(22) Filed: Nov. 5, 2010

(65) Prior Publication Data

US 2012/0114458 A1 May 10, 2012

(51) Int. Cl.
*F04D 29/58* (2006.01)

(52) U.S. Cl.
USPC ..... 415/115; 415/174.3

(58) Field of Classification Search
USPC ..... 415/115, 168.1, 168.2, 173.6, 173.7, 415/174.3, 174.2
See application file for complete search history.

(56) References Cited

U.S. PATENT DOCUMENTS

| | | | | |
|---|---|---|---|---|
| 5,211,533 | A | 5/1993 | Walker et al. | |
| 5,967,745 | A | 10/1999 | Tomita et al. | |
| 2011/0058933 | A1* | 3/2011 | Gomez | 415/168.2 |

* cited by examiner

*Primary Examiner* — Dwayne J White
(74) *Attorney, Agent, or Firm* — Ernest G. Cusick; Frank A. Landgraff

(57) ABSTRACT

A method and system for improving performance of a compressor section of a gas turbine by diverting leakage air flowing from high pressure downstream of a stator vane assembly to low pressure upstream of the stator vane assembly from disrupting design flow patterns at a leading edge of stator vanes. A cover is provided at a forward face of an inner shroud assembly to prevent the leakage air from impinging on the leading edge. The cover may be provided at an outlet channel of a flow diverter mounted on the forward face of the inner shroud assembly.

16 Claims, 10 Drawing Sheets

SHROUD LEAKAGE COVER

BACKGROUND OF THE INVENTION

The present invention relates to turbomachinery and axial flow compressors. More particularly, the present invention pertains to a shroud leakage cover, which can be applied to the inner shroud region of stator vanes in a compressor of a gas turbine engine. The shroud leakage cover protects against direct impingement of the leakage air onto a leading edge of the stator vanes and degraded compressor performance resulting therefrom.

Gas turbine engines have been utilized to power a wide variety of mechanical drives for vehicles and electrical power production. The operation of a gas turbine engine can be summarized in a three-step process in which air is compressed in a rotating compressor, heated in a combustion chamber, and expanded through a turbine. The power output of the turbine is utilized to drive the compressor and any mechanical load connected to the drive. Axial-flow compressors may comprise a plurality of annular disk members carrying airfoils at the peripheries thereof. Some of the disk members are attached to an inner rotor and are therefore rotating (rotor) blade assemblies while other disk members depend from an outer casing and are therefore stationary (stator) blade or vane assemblies. The airfoils or blades act upon the fluid (air) entering the inlet of the compressor and raise its temperature and pressure preparatory to directing the air to a continuous flow combustion system. The stator vanes redirect and diffuse air exiting a rotating blade assembly into an optimal direction for a following rotating blade assembly. The air entering the inlet of the compressor is at a lower total pressure than the air at the discharge end of the compressor, the difference in total pressure being known as the compressor pressure ratio. Internally, a static pressure rise occurs across the stator vanes from diffusion and velocity reduction.

For a number of reasons having primarily to do with the design parameters of the cycle utilized in a particular engine, it is undesirable for the higher static pressure and higher static temperature air at the discharge side of a stator vane assembly to find its way back into the primary air flow at the inlet side of the stator vane assembly. This air, which returns to the relatively low static pressure area at the vane assembly inlet, is called leakage air and results in reduced engine efficiency. Leakage of air within the compressor thus detracts not only from the efficiency of the compressor itself, but also the overall efficiency of gas turbine engine operation.

Labyrinth seals connected radially inward from the stator vane assemblies of the compressor stage and sealing against the inner rotor have long been utilized as a means to prevent leakage flow about the primary working fluid path around the stator vane assemblies. Notwithstanding the use of labyrinth seals, some leakage does occur, and this leakage air will travel, for example, from the high static pressure downstream side of a stator vane assembly to the lower static pressure at the upstream side of the stator vane assembly via a path which exists between the radial inward end of the stator vane assembly and the labyrinth seals connected to the rotor. After traveling to the upstream side of the stator vane assembly, the leakage air travels in a radially outward manner in the cavity existing between the stator vane assembly and adjacent rotor assembly. This radial path taken by the leakage air has a tendency to reduce the velocity and axial direction of air traversing the working fluid flow path of the compressor and tends to increase the amount of bleed air which further contributes to engine inefficiency.

Efforts have been made (Walker et al. in U.S. Pat. No. 5,211,533) for diverting leakage air back into the flow path of a turbine engine. A stator vane assembly may be connected to a shroud assembly at the radially inner end of the stator vane assembly. The shroud assembly is provided with a scoop, which is placed in the path of leakage air traversing in a forward direction from the high-pressure static side of the stator vane to the low static pressure side of the stator vane. The leakage path is located between the stator vane assembly and a rotating member. The scoop intercepts the leakage air and re-directs the leakage air into an airflow path of the compressor with an aftward component of velocity.

However, the leakage flow that is coming into the flowpath in the radial direction has a strong negative impact on the axial momentum of the fluid in the vicinity of the injection. The reduction in axial momentum increases the loading on the leading edge of the airfoil, which can lead to separated flow and compressor surge. It would be desirable to eliminate this adverse impact on the leading edge of the stator vane while maintaining the axial component of velocity imparted to the leakage air returning to the compression flow.

BRIEF DESCRIPTION OF THE INVENTION

According to a first aspect of the present invention, a system is provided for directing leakage air, flowing from a high static pressure side to a lower static pressure side of a stator vane located in a compressor of a turbine engine, back into a primary working fluid flow path of the compressor to avoid interfering with the working fluid flow at a leading edge of the stator vane. The system includes a stator vane, a shroud member connected to the radially inner extreme of said stator vane, a stationary seal assembly connected to the radially inner extreme of said shroud member, and a rotatable sealing means located radially inward from said stationary seal assembly, a leakage flow path being formed at the interface between said rotatable sealing means and said seal assembly. Means are provided for directing the leakage airflow into the primary working fluid path away from the leading edge of the stator vane to avoid interfering with the working fluid flow, which would otherwise impair compressor performance.

According to another aspect of the present invention, a system is provided for directing leakage air, flowing from a high static pressure side to a lower static pressure side of a stator vane assembly located in a compressor of a turbine engine, back into a primary working fluid flow path of the compressor in such a manner that the leading edges of the stator vanes are protected from direct impingement by the re-directed leakage air. The system includes a stator vane assembly providing a plurality of circumferentially spaced stator vanes secured to a stationary casing element of the engine, a rotor means located radially inward from said stator vane assembly, wherein the rotor means and stator vane assembly define a leakage airflow path leading from a higher static pressure cavity located to the aft of said stator vane assembly to a lower static pressure cavity located forward of the stator vane assembly; and means for directing the leakage airflow from the leakage airflow path back into a primary working fluid path in such manner that the leakage airflow is diverted from leading edges of the plurality of circumferentially spaced stator vanes.

According to another aspect of the present invention, a method is provided for improving performance of a gas turbine compressor by diverting leakage airflow flowing from a high static pressure side located to the aft of a stator vane to a forward side of said stator vane assembly from disturbing aerodynamic flow at a leading edge of stator vane. The method includes positioning a radially inner edge of a flow diverter radially inward of the leakage air path on the lower static pressure side of the stator vane assembly, intercepting the leakage air flowing from the higher static pressure side to the lower static pressure side of the stator vane assembly, rejoining with a primary work flow and shielding the leading edge of the plurality of airfoils from the leakage air flow with a covers in proximity to the leading edges.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The following embodiments of the present invention have many advantages, including improving overall gas turbine performance by improving performance of the compressor section.

A method and system are provided for improving performance of a compressor section of a gas turbine by diverting leakage air flowing from high pressure downstream of a stator vane assembly to low pressure upstream of the stator vane assembly from disrupting design flow patterns at a leading edge of stator vanes. A cover is provided at a forward face of an inner shroud assembly to prevent the leakage air from impinging on the leading edge. The cover may be provided at an outlet channel of a flow diverter mounted on the forward face of the inner shroud assembly.

Figure 1:
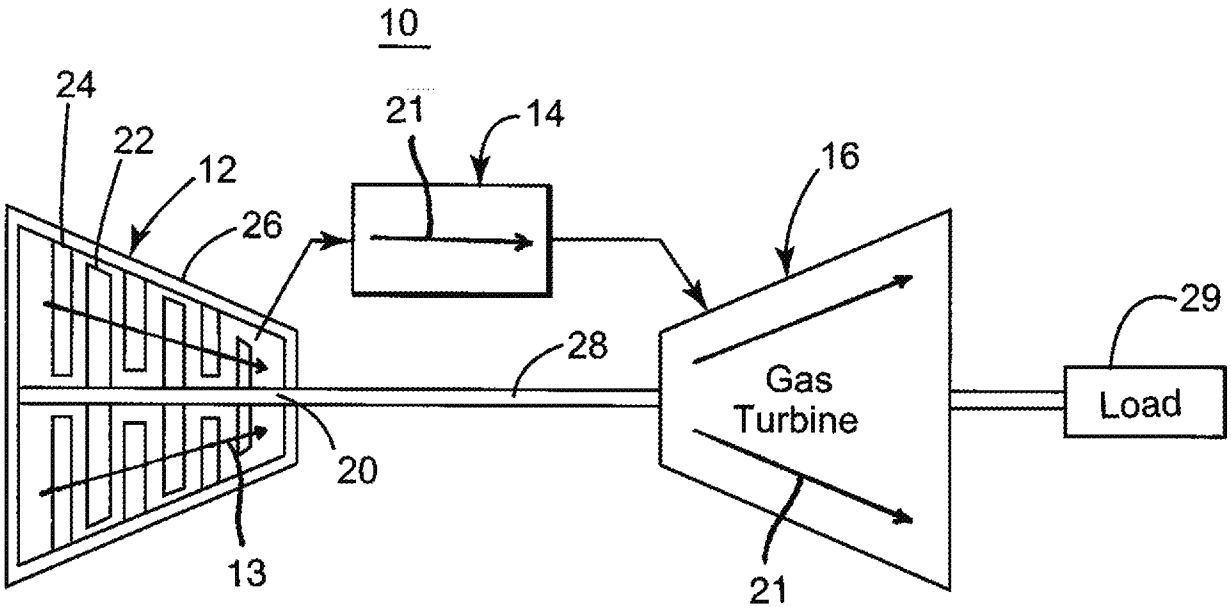
FIG. 1 schematically illustrates basic operation of a gas turbine engine.

FIG. 1 schematically illustrates basic operation of a gas turbine engine 10. The engine 10 comprises a compressor 12, a combustor 14 and a turbine 16. The compressor 12 includes a rotor 20 having a plurality of rotor blades 22 arranged in stages along its length and cooperating with stator vanes 24 extending inwardly from an outer casing 26, thereby forming an axial flow of pressurized air to support combustion in the combustor 14. The compressor outer casing 26 in combination with the rotor 20 defines an annular flow path 13 leading to the combustor 14.

The hot gas stream 21 generated in combustor 14 drives the turbine 16 to derive power for rotating load 29 and the compressor rotor 20, which is connected thereto by a shaft 28. After passing through the turbine, the hot gas stream 21 may be discharged to an exhaust.

Figure 2:
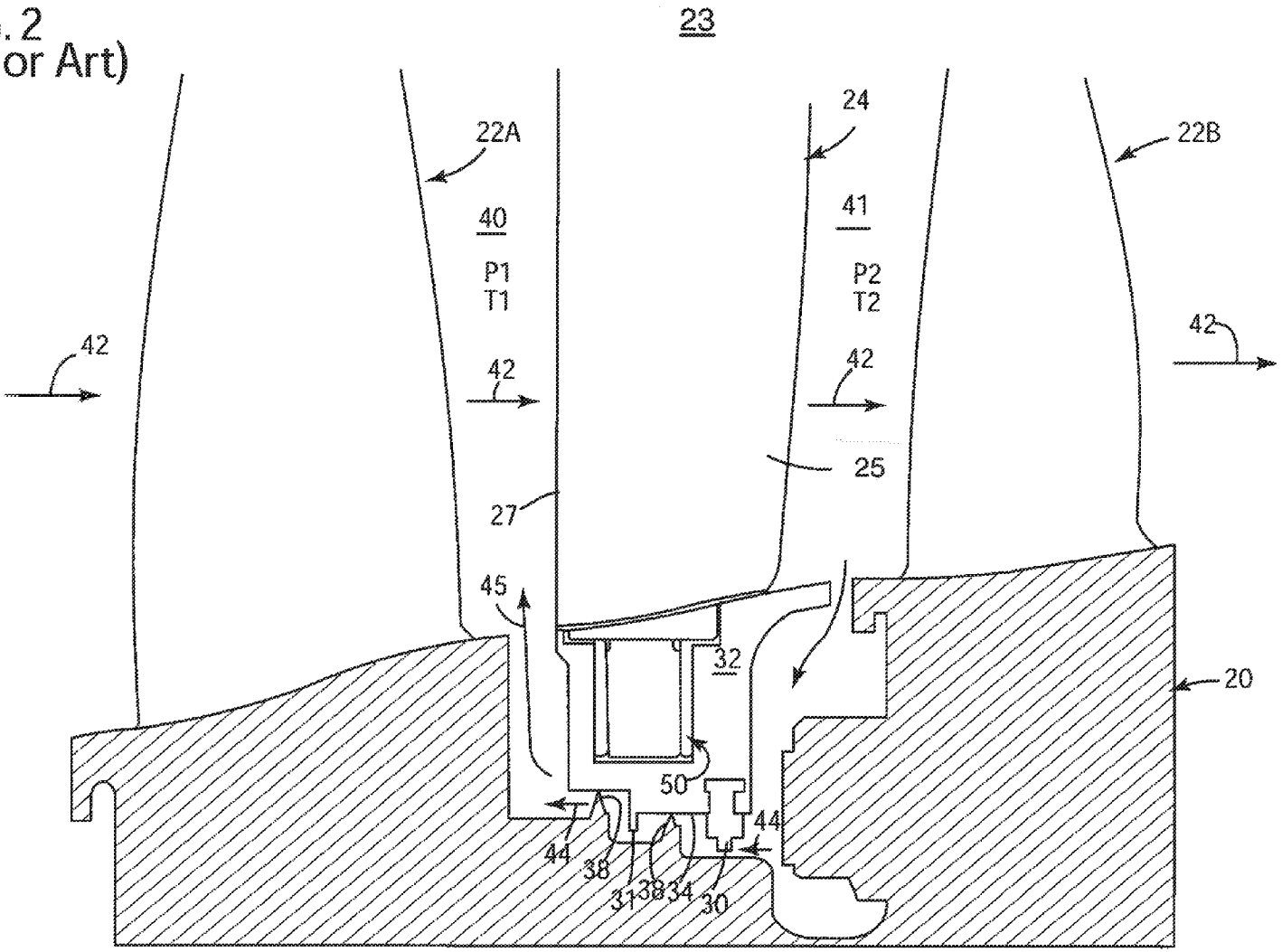
FIG. 2 (Prior Art)
FIG. 2 illustrates a segment of a conventional prior art turbine engine compressor.

FIG. 2 illustrates a segment of a conventional prior art turbine engine compressor 12 depicting stator vane assembly 24, which lies between rotor blades 22A and 22B, respectively. The stator vane assembly includes a radially inner shroud assembly 32. Different combinations of seals (such as a brush seal 30 and an edge seal 31) may be connected to a radially inner face 34 of inner shroud assembly 32. Seals such as, but not limited to, one or more tooth edge seals 38 may be mounted to the rotor 20. The inner shroud assembly 32 may also house a lower rotating mechanism 50 that works with an upper rotating mechanism (not shown) to position the stator blade 25 based on gas turbine operating conditions.

Working fluid, e.g., air, compressed by rotating blade 22A enters space 40 between rotor blade 22A and stator vane 24 with a static air pressure of $P_1$ and a static temperature $T_1$. This air has a circumferential component and is desirably re-directed by stator blade 25 into an optimal direction for impingement onto a succeeding rotating blade 22B. To the downstream side of stator vane 24 in space 41, the air has a static air pressure of $P_2$ and a static temperature $T_2$. Air pressure $P_2$ is greater than air pressure $P_1$ and temperature $T_2$ is greater than temperature $T_1$. The greater air pressure $P_2$ and higher temperature $T_2$ can be appreciated by the fact that the air is re-directed and diffused to a lower velocity in airflow path 42 in space 41, hence causing an increase in temperature and pressure as it moves downstream through the compressor.

The space between the rotor 20 and the inner radial face 34 of the inner shroud 32 may be formed with tight clearances by the seals 30, 32, 38. However, the sealing is not absolute, allowing a leakage air path 44 from the high pressure $P_2$ to the lower pressure $P_1$. This leakage air 45 then flows radially outward and re-enters the working fluid stream 42, in a direction generally perpendicular to a direction of the working fluid flow. The resulting turbulence reduces compressor and engine efficiency.

Figure 3:
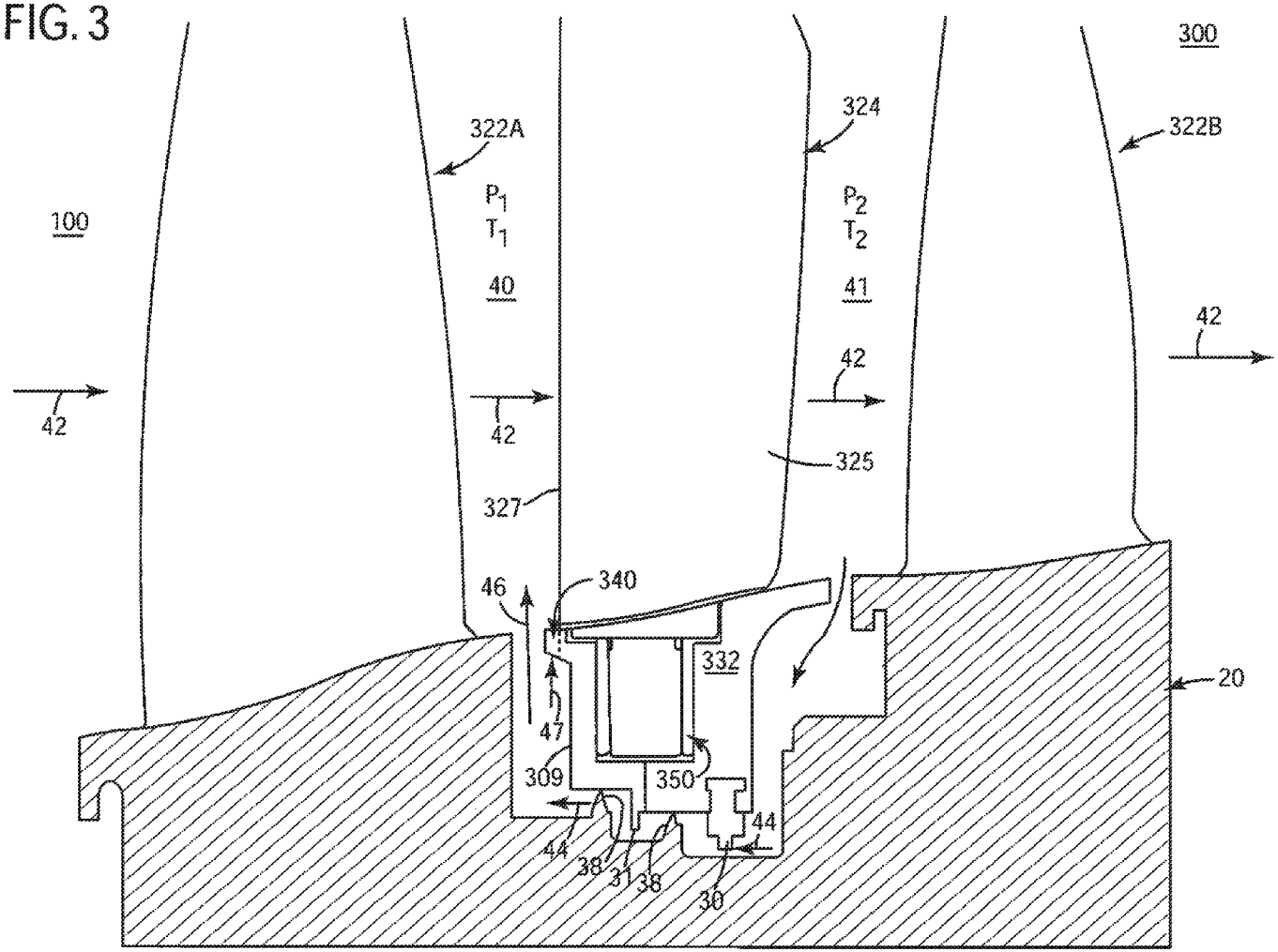
FIG. 3 illustrates a segment of a turbine engine compressor depicting a stator vane assembly between adjacent rotor blades according to an embodiment of the present invention.

FIG. 3 illustrates a segment of a turbine engine compressor 300 depicting stator vane assembly 324, which lies between rotor blades 322A and 322B according to an embodiment of the present invention. The structural arrangement for the stator vane assembly 324 includes a stator vane 325 with leading edge 327 and an inner shroud assembly 332. The inner shroud assembly 332 may also house a lower rotating mechanism 350 that works with an upper rotating mechanism (not shown) to position the stator blade 325 based on gas turbine operating conditions. The inner shroud assembly 332 forms a restrictive air leakage path 44 between the brush seal 30 and the edge 31 with one or more tooth edges seals 38 of the rotor 20. The air leakage path may alternatively be restricted with other number and types of seals between the inner shroud assembly 332 and the rotor 20.

The inner shroud assembly 332 may further be provided with a front cover 340 disposed around a front face 309 of the inner shroud assembly 332. The front cover 340 may be formed integrally with the inner shroud assembly or may be a separate element mounted to the inner shroud assembly according to known means. Parts of the front cover 340 may extend axially upstream from the front face 309 of the inner shroud assembly 332 into leakage flow 46 that mixes with working fluid flow 42. The front cover parts will preferentially be placed in circumferential proximity to the leading edge 327 of the stator blade 325, thereby shielding the vicinity of the leading edge from impingement by the leakage airflow 47. Other parts of the front face 309 of the inner shroud assembly 332 may not be covered, thereby allowing leakage flow 47 to pass along the uncovered sections of the front face away from the leading edge of the stator vane. The front cover 340 may be formed as a cover ring mounted to the forward face of the inner shroud assembly or as discrete cover elements, both types being further described.

Figure 4:
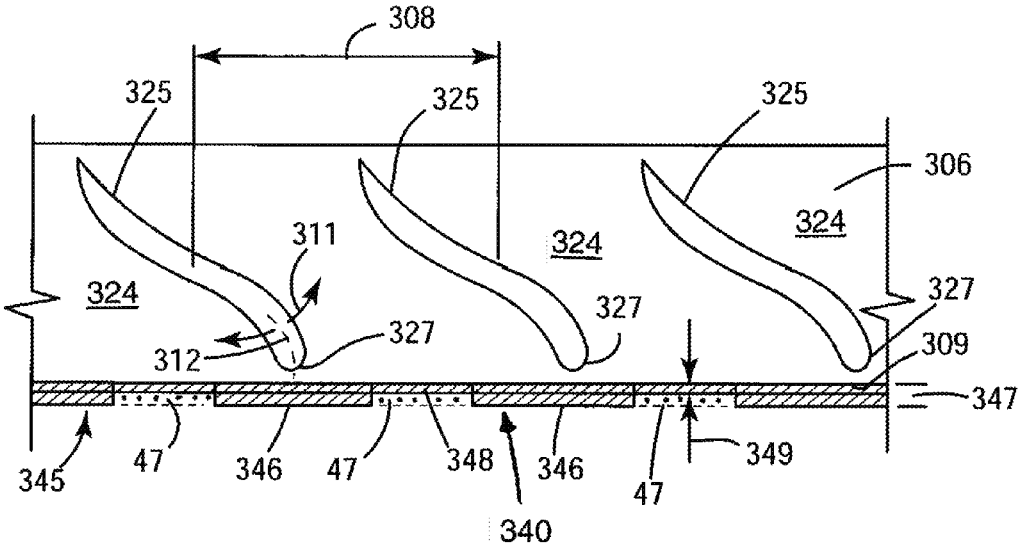
FIG. 4 illustrates a top view of a section of a stator vane assembly with a front cover ring.

FIG. 4 illustrates a top view of a stator vane assembly 324 with an embodiment of an inventive front cover 340. The section includes three stator vanes 325 on top surface 306 of the inner shroud assembly 332 with stator pitch 308. The front cover 340 may be formed as a cover ring 345 (a portion of which is shown) is mounted on the front face 309 of the inner shroud assembly 332. The cover ring 345 may include shielded sectors 346 positioned in circumferential proximity to the leading edges 327 of the stator blades 325 where the shielded sectors include an increased axial thickness 347 that extends in the upstream direction of the working fluid flow 42 from forward face 309. The thickness 347 of cover ring 345 assists in shielding the leading edge 327 from impingement by the leakage flow 47 (represented by arrow points) that would otherwise disrupt the design flow of the working fluid flow 42 (FIG. 3). Over the remaining unshielded sectors 348 of the cover ring 345 away from the leading edge 327 of the stator vanes, shielding is not required and a relatively thin depth 349 of the cover ring is provided to prevent unnecessary restriction of leakage flow. The shielded sector 346 of the circumference of the forward face 309 of the inner shroud assembly 332 may be from about 30% of pitch to about 70% of pitch 308 of the stator blades 325. Such broad shielding is desirable as certain stator blades 325 are rotatable on an axis about the lower rotating mechanism 50 and the upper rotating mechanism (not shown) such that the leading edge 327 of the stator blade 325 moves in response to compressor operational conditions and should desirably be shielded over the full range of rotational motion. For fixed stator blades, the shielded thickness may be centered on the leading edge 327 of the stator vanes. For rotatable stator blades (indicated by arc 311), the shielded thickness may be centered on the center of rotation 312 for the stator blade.

Figure 5:
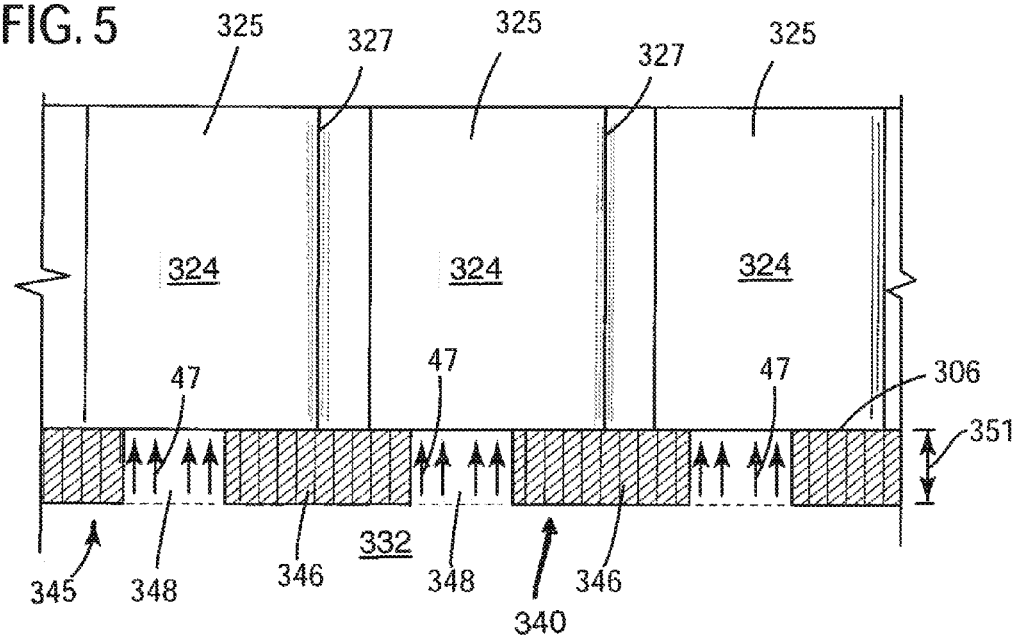
FIG. 5 illustrates a downstream view of a section of a stator vane assembly with a front cover ring.

FIG. 5 illustrates a downstream facing view, in the direction of the working fluid flow, for a sector of a stator vane assembly 324 with an embodiment of the inventive front cover ring 345. The sector includes for representational purposes three stator blades 325 with leading edges 327. The front cover ring 345 may be bounded on an outer radial end by the top surface 306 of the inner shroud assembly 332 and extend in an inward radial direction by a depth 351. The shielded sectors 346 of increased axial thickness 347 (FIG. 4) may be nominally centered on the leading edge 127. The unshielded sectors 348 of limited thickness may lay therebetween. Leakage flow 47 along the front face 309 of the inner shroud assembly is blocked in shielded sectors 346 and is passed in ring sectors 348 away from the leading edge.

Figure 6:
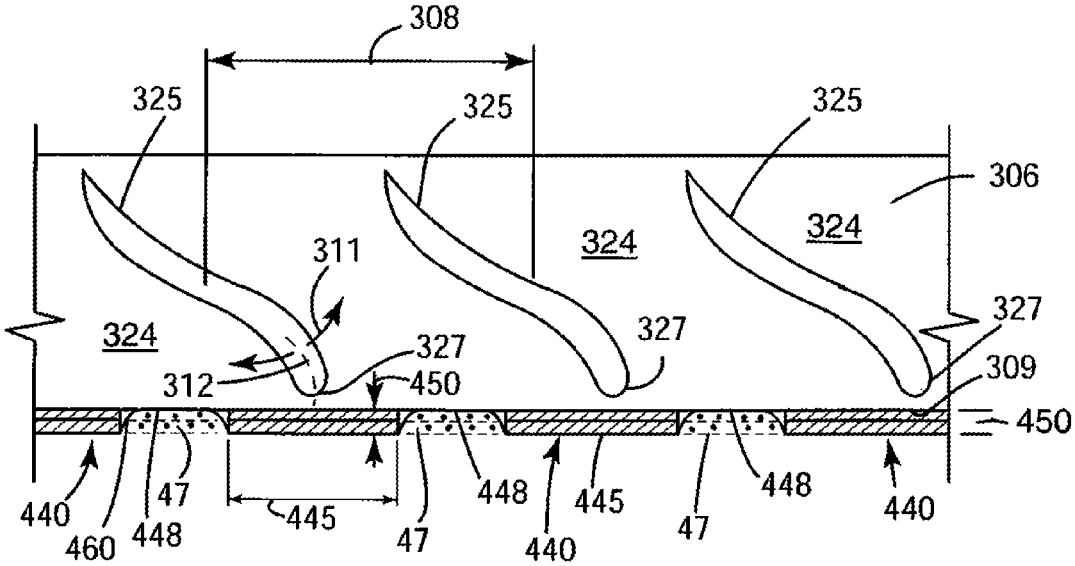
FIG. 6 illustrates a top view of a section of a stator vane assembly with discrete front cover elements.
Figure 7:
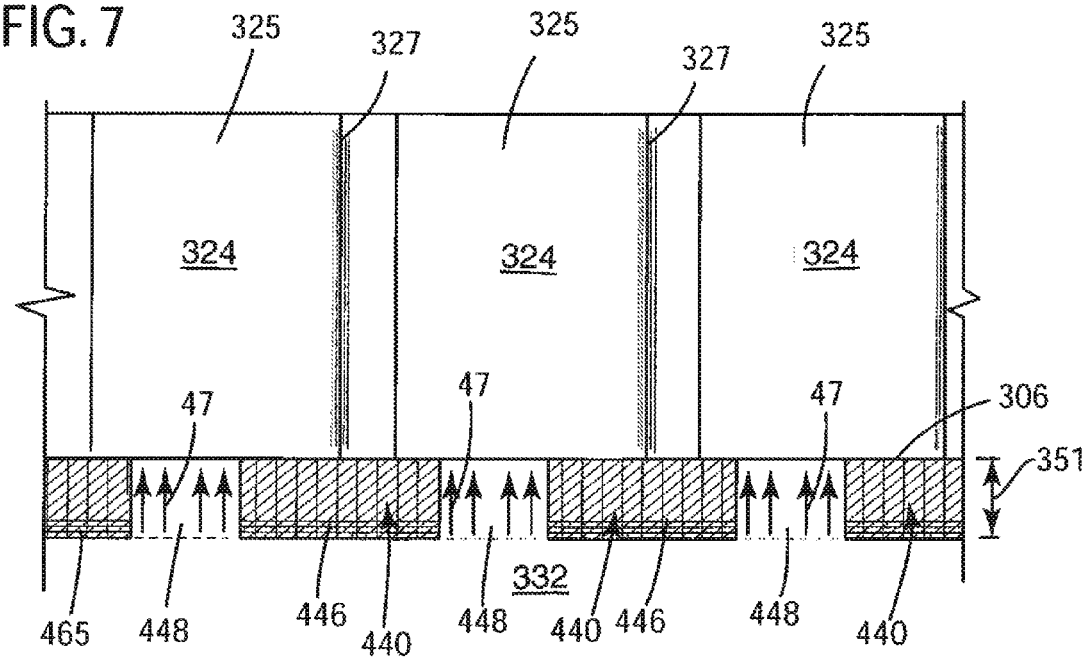
FIG. 7 illustrates a downstream view of a section of a stator vane assembly with discrete front cover elements.

FIG. 6 illustrates a top view of a section of a stator vane assembly with an embodiment of inventive discrete front covers. FIG. 7 illustrates a downstream view of a section of a stator vane assembly with discrete front covers. The section includes three stator vanes 325 atop the inner shroud assembly 332 with stator pitch 308. Discrete covers 440 are provided in circumferential proximity to the leading edge 327 of each stator vane 325. The discrete covers 440 include an axial thickness 450 that may extends in the upstream direction of the working fluid flow 42 from the front face 309 of the inner shroud assembly 332. The thickness 450 of the covers assists in shielding the leading edge 327 of the blade 325 from impingement by the leakage flow 47 that disrupts design flow of the working fluid flow 42 (FIG. 3) around the leading edge 127. The circumferential span 445 of each discrete cover 440 may be from about 30% of pitch to about 70% of pitch of the stator vanes, with the cover being nominally centered on the leading edges 327. In the uncovered circumference 448 of the forward face 309 of the stator vane assembly 332 away from the leading edge of the stator blades, shielding is not required so the cover need not be provided. Such broad shielding is desirable as the stator blades 325 are rotatable on an axis about the lower rotating mechanism 50 and the upper rotating mechanism (not shown) such that the leading edge 327 of the stator blade moves and should desirably be shielded over the full range of rotational motion. Various tapers of the discrete covers 440 may be provided in a radial direction and circumferential direction to facilitate a smooth flow of the leakage air 47 around the covers in unshielded locations. The inner radial surface 465 of the front cover element may include a taper to the front face 309 of the inner shroud assembly 332. The circumferential surfaces 460 of the front cover 440 may taper to the front face 309 of the inner shroud assembly 332.

Figure 8:
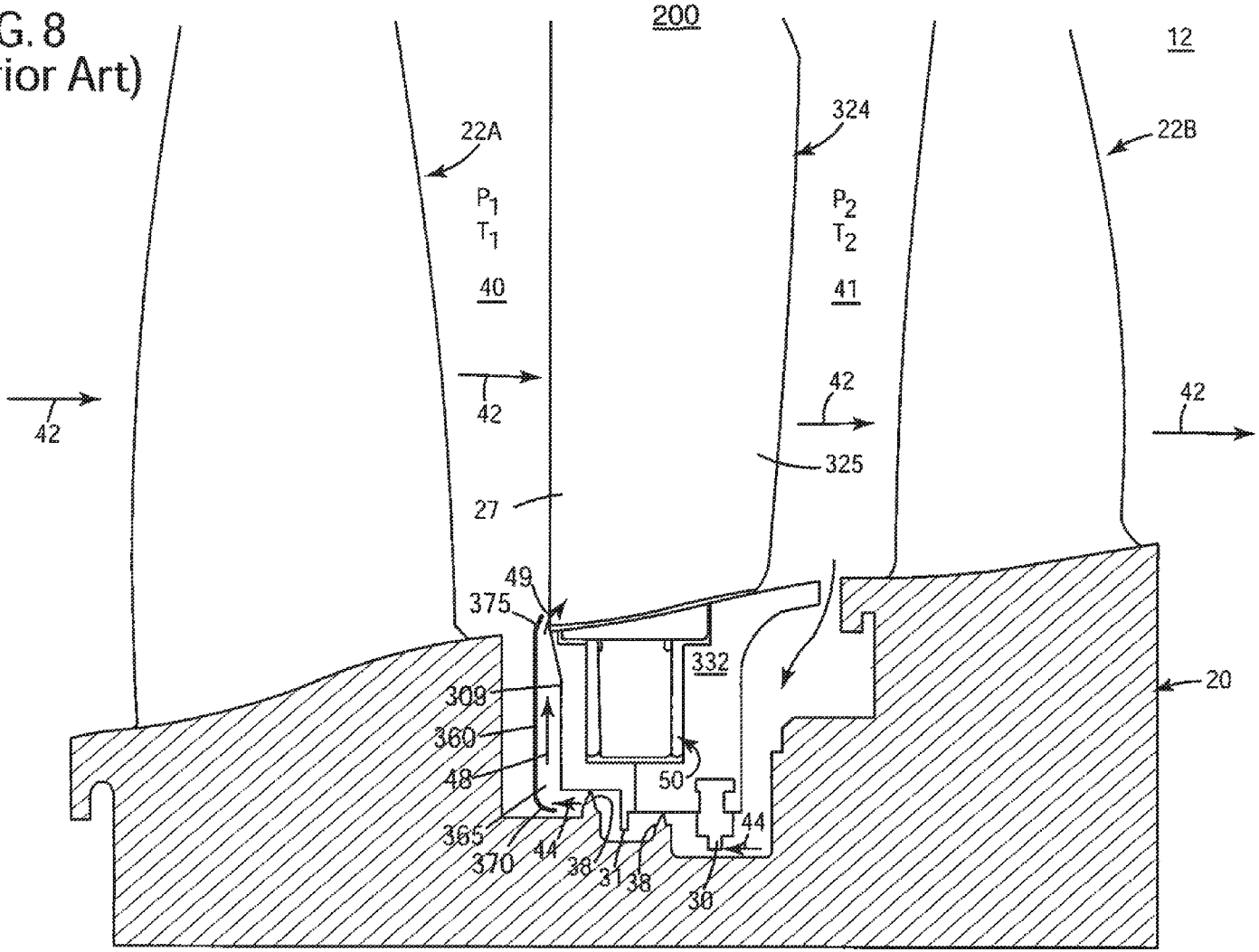
FIG. 8 (Prior Art)
FIG. 8 illustrates a prior art segment of a turbine engine compressor depicting stator vane assembly, which lies between rotor blades.

FIG. 8 illustrates a prior art segment of a turbine engine compressor 200 depicting stator vane assembly 324, which lies between rotor blades 22A and 22B. The structural arrangement for the stator vane assembly 324 includes a stator blade 325 with leading edge 327 and an inner shroud assembly 332. The inner shroud assembly 332 may also house a lower rotating mechanism 50 that works with an upper rotating mechanism (not shown) to position the stator blade 325 based on gas turbine operating conditions. The inner shroud assembly 332 forms a restrictive air leakage path 44 between the brush seal 30 and the edge 31 with one or more tooth edges seals 38 of the rotor 20. The air leakage path may alternatively be restricted with other number and types of seals on the inner shroud assembly 332.

The inner shroud assembly may further be provided with a flow diverter 360 (also called flow splitter) to more effectively introduce the leakage flow 44 between the rotor 20 and the inner shroud assembly 332 back into the working fluid stream 42. The annular flow diverter 360 is disposed around an upstream face 309 of the inner shroud assembly. The flow diverter 360 is offset from the upstream face 309 establishing a channel 365 therebetween. The inner radial end of the flow diverter 360 may include a downstream curvature forming a scoop 370 to collect a substantial portion of the leakage flow 44. The collected portion 48 of the leakage flow 44 may flow outward radially up the channel 365. An outer radial end of the flow diverter 360 may include a downstream curvature forming a discharge element 375 that adds a downstream velocity component to leakage, thereby improving the efficiency of the working fluid 42/leakage flow 48. However, this arrangement fails to protect against leakage air impingement around the leading edge 327 of stator blade 325 disrupting design flow patterns and leading to less than optimal blade performance.

According to a further embodiment of the present invention, a cover may be provided for flow from the flow diverter to prevent the discharge of leakage air passing through the flow diverter from adversely impacting the design flow of working fluid at the leading edge of the stator vanes.

Figure 9:
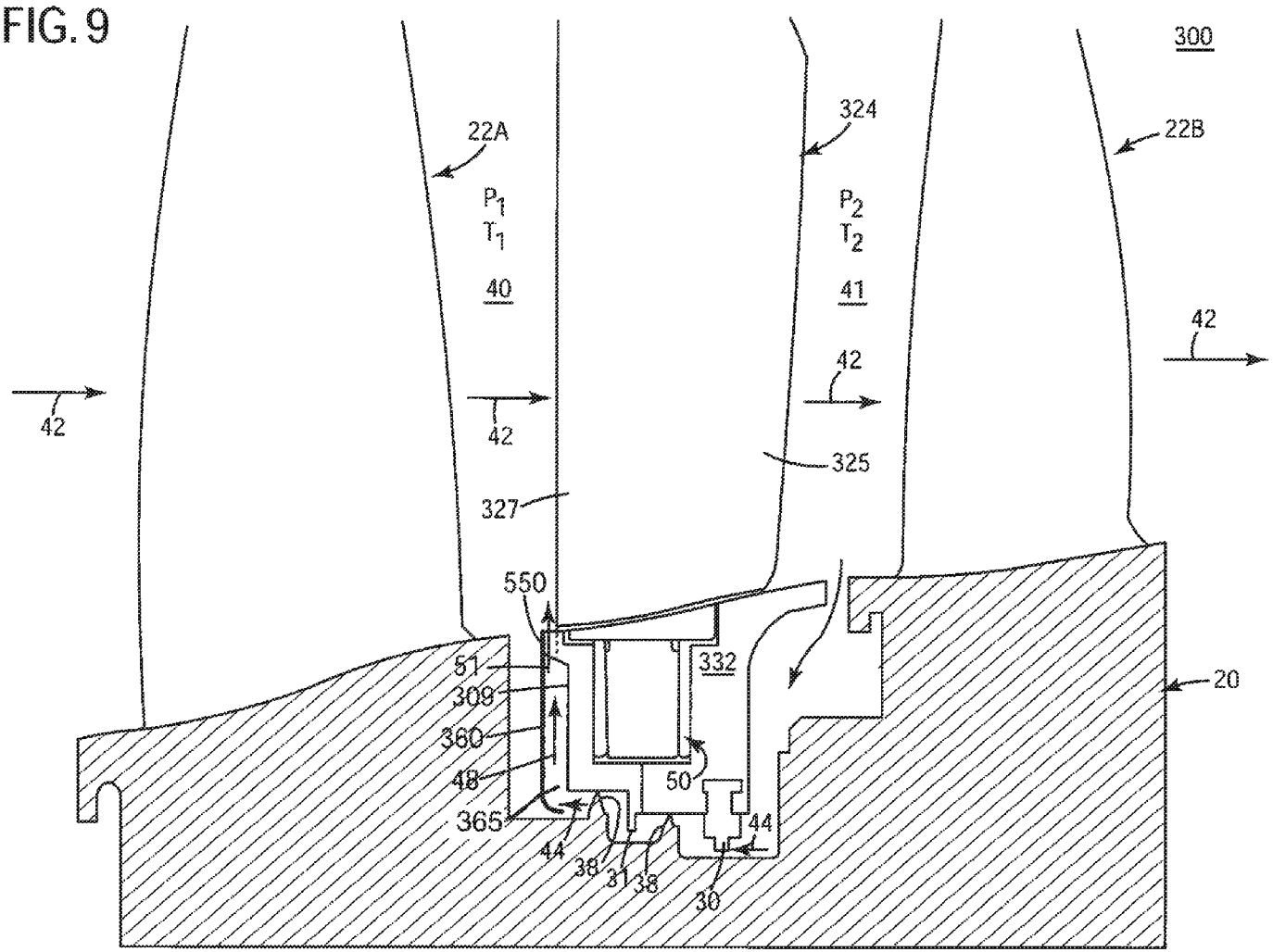
FIG. 9 illustrates an axial view of a cover for a flow diverter mounted in proximity to a leading edge of the stator vanes, according to an embodiment of the present invention.

FIG. 9 illustrates an axial view of a front cover 550 used with a flow diverter 360 mounted in proximity to a leading edge of the stator vanes, according to an embodiment of the present invention. The cover 550 may be a part of the front face 309 of the inner shroud assembly 332 or alternatively may be a separate element mounted between the front face of the inner shroud assembly 332 and the flow diverter 360. The cover 550 protects the leading edge 327 of the stator vane 325 from disruption to the flow patterns of working fluid, which will degrade vane performance. The cover 550 may extend axially upstream from the front face 309 of the inner shroud assembly 332 into leakage flow 48 that mixes with working fluid flow 42. The cover 550 may be formed as a ring (See 445 FIGS. 4, 5) mounted to the forward face of the inner shroud assembly. The cover 550 may include sectors positioned in circumferential proximity to the leading edges 327 of the stator blades 325 where the sectors include an increased axial thickness that extends in the upstream direction of the working fluid flow 42. The sectors of increased thickness may shield the leading edge from impingement by the leakage flow. In the remaining circumference of the ring 145 away from the leading edge of the stator vanes, shielding is not required and a relatively thin thickness of the ring is provided to prevent unnecessary restriction of leakage flow (See FIGS. 3, 4, 5). Alternatively, discrete cover elements 440 (as previously described for stator vane assembly without flow diverter in FIGS. 6, 7) may be positioned between the flow diverter 360 and the front face 309.

The sector of the circumference of the face of the inner shroud assembly being shielded may be from about 30% of pitch to about 70% of pitch of the stator vanes. Such broad shielding is desirable as the stator blades 325 are rotatable on an axis about the lower rotating mechanism 50 and the upper rotating mechanism (not shown) such that the leading edge 327 of the stator blade 325 moves and should desirably be shielded over the full range of rotational motion.

Figure 10:
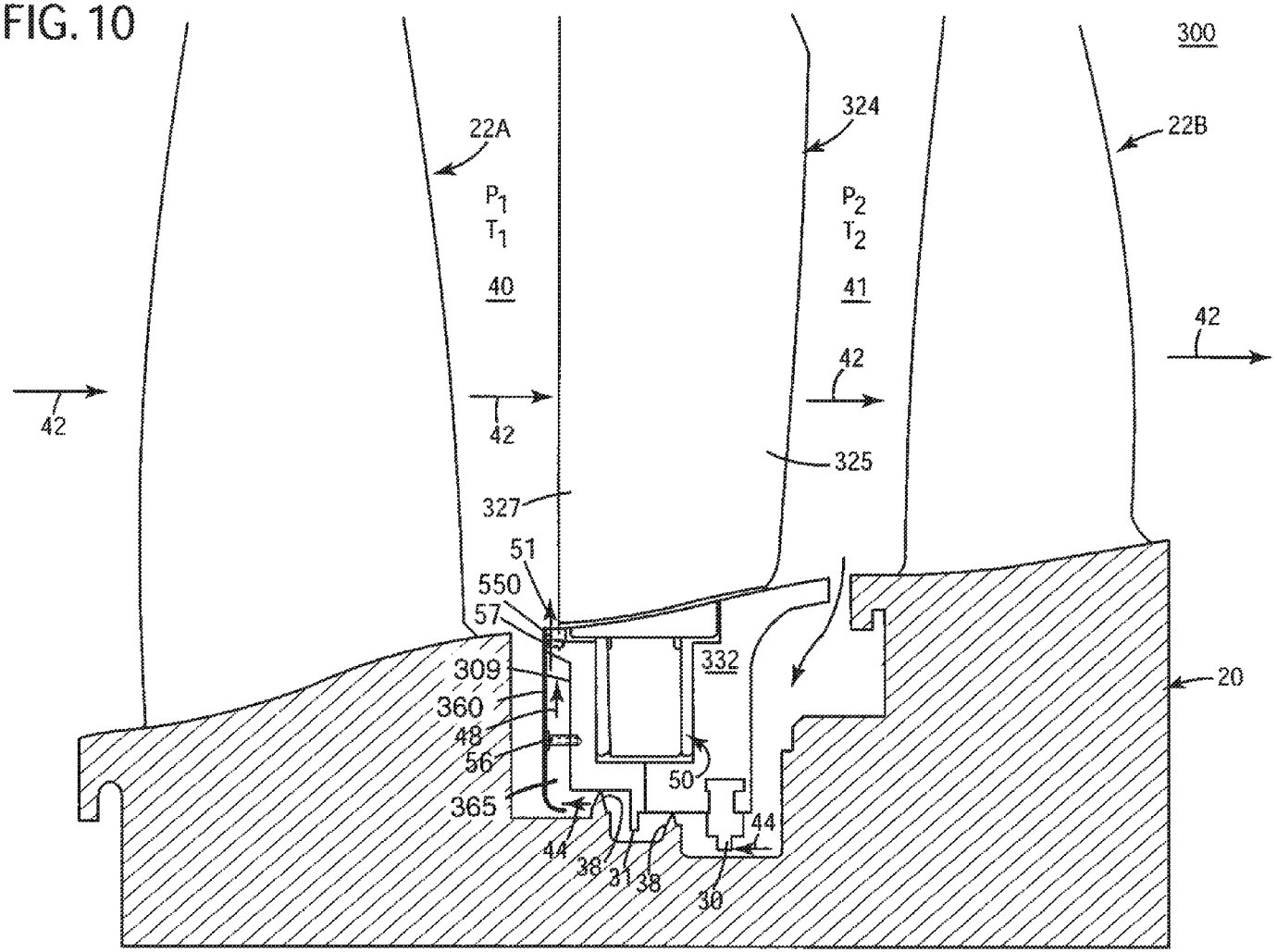
FIG. 10 illustrates an axial view of mounting of flow cover elements with flow diverter to forward face of the inner shroud assembly.

FIG. 10 illustrates an axial view of an embodiment for inventive flow covers for a flow diverter at a forward face of an inner shroud assembly. Flow cover 550 may be formed integrally with or may be fastening to the forward face 309 of the inner shroud assembly 332. Attachment of the flow cover 550 may to the forward face of inner shroud assembly 332 may be with bolting 57 or other known attachments methods and may also simultaneously attach the outer radial end of flow diverter 360 to the inner shroud assembly. The lower end of the flow diverter 360 may be fixed directly to the forward face 309 with bolting 56 or other known means. The flow covers 550 are arranged as previously described in FIGS. 4, 5, 6, 7 to shield the leading edge area 327 of the stator blades 325 from adverse flow pattern over the range of motion of the leading edge 327 for rotatable compressor blade operation or for the fixed position of blades 325 that do not rotate.

Figure 11:
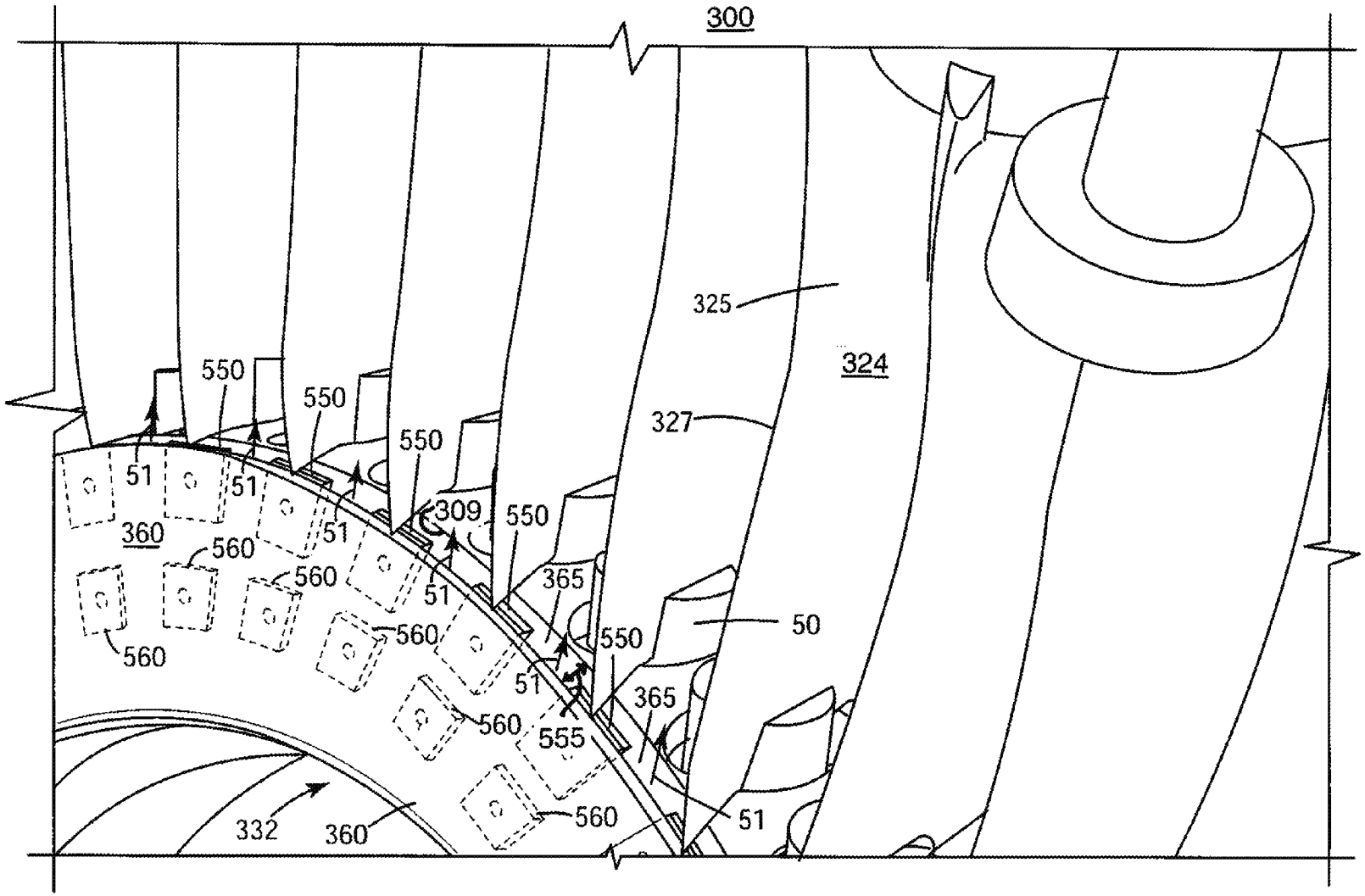
FIG. 11 illustrates an isometric view of a sector of a stator vane assembly with cover for a flow diverter.

FIG. 11 illustrates an isometric view of a sector of a stator vane assembly with cover 550 for a flow diverter 360 for a compressor of a turbine engine 300. The stator vane assembly 324 includes stator blades 325 mounted radially mounted to stator inner shroud. Flow diverter 360 is mounted axially forward from the front face 309 of the stator vane assembly 324, establishing a channel 365 there between. In circumferential proximity to the leading edge 327 of the stator blades 325, discrete flow cover elements 440 are positioned. The flow cover elements 440 may cover a circumferential span of about 30% to about 70% of stator pitch 308 (FIGS. 4, 6). The thickness of the flow cover elements 450 may establish the depth 555 of the channel 365 for leakage airflow 51 at an outer end of the flow diverter 360. The flow cover elements 440 may be attached to the front of the shroud by known attachment methods. The flow diverter 360 may further be fastened to the front face 309 of the inner shroud assembly 332 through the flow cover element 440*s*.

Figure 12:
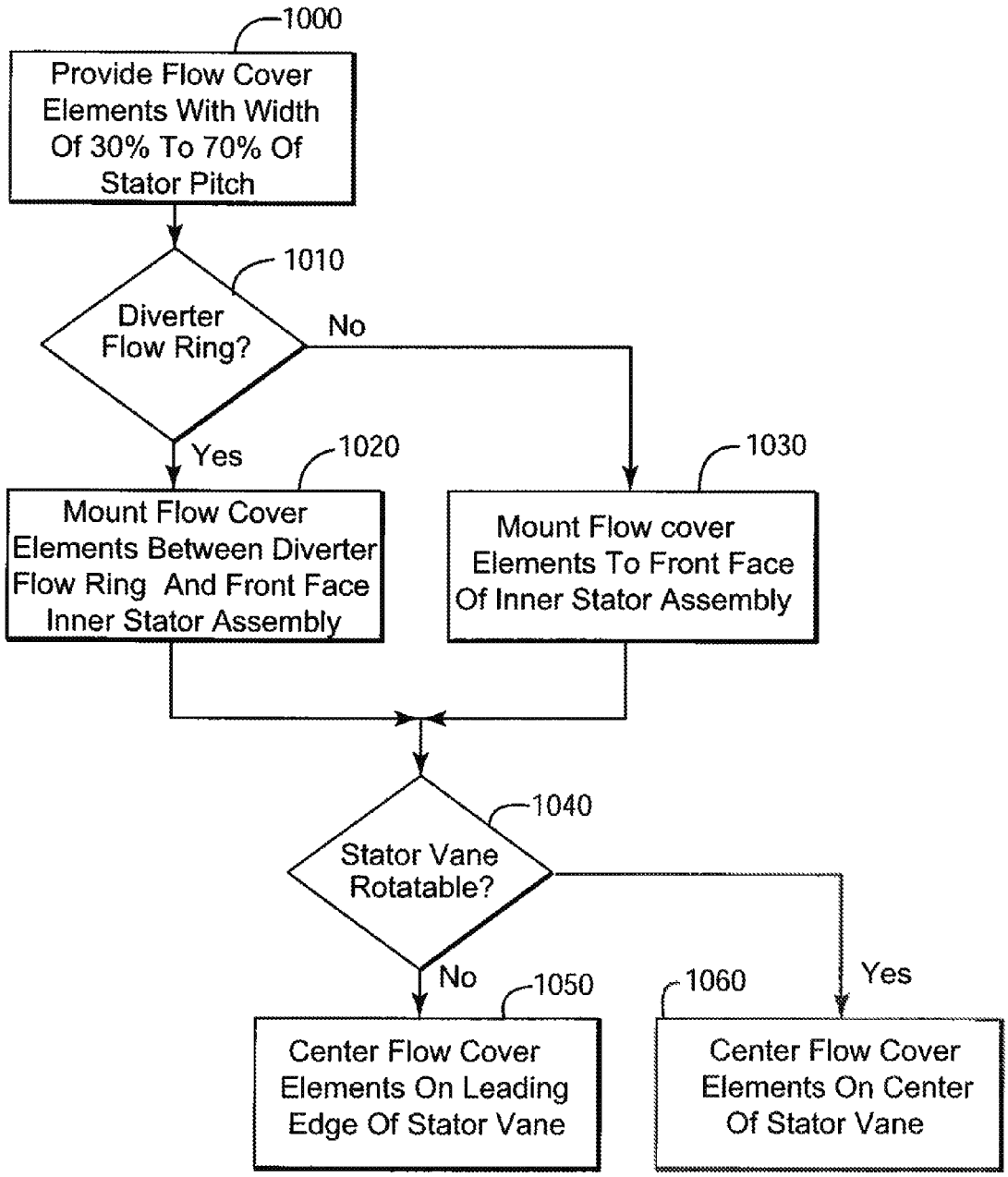
FIG. 12 illustrates a flow chart for a method of diverting leakage flow from a leading edge of stator vanes in a compressor stage for a gas turbine.

A method is provided for improving performance of a gas turbine compressor by preventing leakage airflow flowing from a high static pressure side located to the aft of a stator vane to a forward side from disturbing aerodynamic flow at a leading edge of stator vane. FIG. 12 illustrates a flow chart for a method of diverting leakage flow from a leading edge of stator vanes in a compressor stage for a gas turbine. Step 1000 includes providing flow cover elements adapted for mounting which include a circumferential width of about 30% to about 70% of stator vane pitch. Step 1010 includes determining if flow cover elements are to be provided for a leakage path that includes a flow diverter ring. If the leakage path includes a flow diverter ring, then in step 1020 mount the flow cover elements at an outlet of a channel between the flow diverter ring and a forward face of the inner shroud assembly in proximity to the leading edges of the stator blades. If the leakage path in step 1010 does not include a flow diverter ring, then in step 1030 mount the flow cover elements at a forward face of the inner shroud assembly in proximity to the leading edges of the stator blades. In step 1040, it is determined if the stator vanes are fixed or rotatable. If the stator blades are fixed vanes then in step 1050 center a circumferential dimension of the flow cover element on the leading edge of the stator vane. If the stator blades are movable vanes, then in step 1060 center of the flow cover elements on the center of rotation for the leading edge of the stator blade.

While various embodiments are described herein, it will be appreciated from the specification that various combinations of elements, variations or improvements therein may be made, and are within the scope of the invention.

The invention claimed is:

1. A system for directing leakage air, flowing from a high static pressure side to a lower static pressure side of a stator vane assembly located in a compressor of a turbine engine, back into a primary working fluid flow path of the compressor to avoid interfering with the working fluid flow at a leading edge of the stator vane, said system comprising:

a stator vane;

a shroud member connected to the radially inner extreme of said stator vane;

a stationary seal assembly connected to the radially inner extreme of said shroud member;

at least one seal sealing a rotating surface located radially inward from said stationary seal assembly, wherein a leakage flow path is formed at the interface between said at least one seal and said stationary seal assembly; and at least one cover directing the leakage airflow into a primary working fluid path of the compressor to avoid interfering with the working fluid flow at the leading edge of the stator vane, the at least one cover further comprising:

an aftward disposed outlet section of the channel discharging leakage air with an aftward component of velocity back into the primary working fluid path and being disposed in the leakage airflow path between the flow diverter and the inner shroud member in circumferential proximity upstream to the leading edge of the stator vane.

2. The system for directing leakage air according to claim 1, the at least one cover for directing leakage airflow comprising:

a flow diverter connected to a leading edge of said shroud member and having a channel capturing the leakage air which exits the at least one seal, thereby directing the leakage air back into the primary working fluid flow path, said channel in direct fluid communication with said primary working fluid flow path.

3. The system for directing leakage air according to claim 1, wherein the at least one cover is further disposed in proximity to an outlet of the leakage airflow path between the flow diverter and the inner shroud member.

4. The system for directing leakage air according to claim 3, wherein the at least one cover is disposed over a circumferential arc of about 30 degrees to about 70 degrees of stator vane pitch in the leakage airflow path past the stator vane.

5. The system for directing leakage air according to claim 4, wherein the at least one cover is circumferentially disposed symmetrically about a leading edge of the stator vane.

6. The system for directing leakage air according to claim 1, wherein the at least one cover is fixedly attached between leading edge of the lower shroud assembly and an aft wall of the flow diverter, supporting the flow diverter.

7. The system for directing leakage air according to claim 6, wherein the at least one cover comprises an arcuate slice.

8. A system for directing leakage air, flowing from a high static pressure side to a lower static pressure side of a stator vane assembly located in a compressor of a turbine engine, back into a primary working fluid flow path of the compressor in such a manner that the leading edge of the stator vane is protected from direct impingement by the re-directed leakage air, said system comprising:

a stator vane assembly including a plurality of circumferentially spaced stator vanes secured to a stationary casing element of the engine;

a rotor located radially inward from said stator vane assembly, the rotor and stator vane assembly defining a leakage airflow path leading from a higher static pressure cavity located to the aft of said stator vane assembly to a lower static pressure cavity located forward of the stator vane assembly; and means for directing the leakage airflow from the leakage airflow path back into a primary working fluid path in such manner that the leakage airflow is diverted from leading edges of the plurality of circumferentially spaced stator vanes, wherein the means for directing the leakage airflow from the leakage airflow path comprising:

a plurality of covers blocking leakage air wherein the plurality of covers are disposed upstream in the leakage air path in circumferential proximity upstream to the leading edges of said plurality of circumferentially spaced stator vanes.

9. The system for directing leakage air according to claim 8, wherein each cover of the plurality of covers blocks a circumferential arc of about 30 degrees to about 70 degrees of stator vane pitch around the leading edge of the stator vane in the leakage airflow path past the stator vane.

10. The system for directing leakage air according to claim 9, wherein each cover of the plurality of covers is circumferentially disposed symmetrically about a leading edge of the stator vane.

11. The system for directing leakage air according to claim 8, the plurality of covers comprising:

a flow diverter coupled to a forward surface of said stator vane assembly and forming a channel therebetween directing the leakage flow flowing axially forwardly below stator vane assembly to flow radially outward along the forward surface of the stator vane assembly toward the plurality of stator vanes;

wherein said plurality of covers are disposed at an outlet of said channel between said flow diverter and said stator vane assembly in circumferential proximity to said leading edges of said stator vanes.

12. The system for directing leakage air according to claim 10, wherein the each cover of the plurality of said covers is mechanically attached between said flow diverter and said stator vane assembly, providing support at an upper end for the flow diverter.

13. The system for directing leakage air according to claim 10, wherein the plurality of said covers are disposed on said stator vane assembly axially forward from said leading edges of said stator vanes.

14. A method for improving performance of a gas turbine compressor by diverting leakage airflow flowing from a high static pressure side located to the aft of a stator vane to a forward side of said stator vane assembly from disturbing aerodynamic flow at a leading edge of stator vane positioning a radially inner edge of a flow diverter radially inward of the leakage air path on the lower static pressure side of the stator vane assembly;

intercepting the leakage air flowing from the higher static pressure side to the lower static pressure side of the stator vane assembly, rejoining with a primary work flow; and covering the leading edge of the plurality of airfoils from the leakage air flow with a plurality of covers in proximity to the leading edges, wherein the step of covering comprises disposing the plurality of covers upstream and circumferentially oriented relative to the leading edge of the plurality of airfoils.

15. The method for improving performance of a gas turbine compressor according to claim 14, the step of covering further comprises covering the leading edge of the plurality of stator vanes over a circumferential arc of about 30 degrees to about 70 degrees of stator pitch.

16. A method for improving performance of a gas turbine compressor according to claim 14, the step of covering further comprises positioning the covers at an outlet of the channel between the flow diverter and the stator vane assembly.

* * * * *